US010386759B2

(12) United States Patent
Endo

(10) Patent No.: US 10,386,759 B2
(45) Date of Patent: Aug. 20, 2019

(54) BELT UNIT AND IMAGE HEATING APPARATUS

(71) Applicant: CANON KABUSHIKI KAISHA, Tokyo (JP)

(72) Inventor: Michiaki Endo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/938,874

(22) Filed: Mar. 28, 2018

(65) Prior Publication Data

US 2018/0284661 A1 Oct. 4, 2018

(30) Foreign Application Priority Data

Mar. 31, 2017 (JP) ..... 2017-070484
Feb. 6, 2018 (JP) ..... 2018-019218

(51) Int. Cl.

*G03G 15/20* (2006.01)
*G03G 15/16* (2006.01)
*G03G 15/08* (2006.01)
*G03G 21/16* (2006.01)

(52) U.S. Cl.

CPC ..... *G03G 15/2028* (2013.01); *G03G 15/0849* (2013.01); *G03G 15/1615* (2013.01); *G03G 15/1665* (2013.01); *G03G 15/2053* (2013.01); *G03G 21/1685* (2013.01)

(58) Field of Classification Search

USPC ..... 399/107, 110, 122, 320, 328–330
See application file for complete search history.

(56) References Cited

U.S. PATENT DOCUMENTS 7,242,895 B2 * 7/2007 Inada ..... G03G 15/2053 219/216

FOREIGN PATENT DOCUMENTS

JP 2011-197019 A 10/2011

* cited by examiner

*Primary Examiner* — Hoan H Tran
(74) *Attorney, Agent, or Firm* — Canon U.S.A., Inc. IP Division

(57) ABSTRACT

A belt unit for forming a heating nip portion configured to heat a toner image in cooperation with a rotary member facing the belt unit, includes an endless belt, an nip forming member provided along a longitudinal direction of the endless belt on an inner side of the endless belt and configured to contact to an inner surface of the endless belt for forming the heating nip portion, a regulation member configured to regulate a position of the endless belt in the longitudinal direction, and a snap-fit unit formed of the nip forming member and the regulation member and configured to regulate the regulation member from being disengaged from the nip forming member.

16 Claims, 9 Drawing Sheets

BELT UNIT AND IMAGE HEATING APPARATUS

BACKGROUND OF THE INVENTION

Field of the Invention

The present disclosure relates to an image heating apparatus of a belt heating type that heats an image formed on a recording medium, and a belt unit used for the image heating apparatus where the image heating apparatus is mountable on an image forming apparatus, such as a copying machine, a printer, a facsimile, or a multifunction peripheral having these functions.

Description of the Related Art

In an image forming apparatus, such as a copying machine, which employs an electrophotographic method, there is a belt heating type apparatus as one example of a heating apparatus (fixing apparatus) to be mounted on the image forming apparatus in terms of energy saving, such as a reduction in waiting time from power-on of the image forming apparatus to an image formation time, and a reduction in power consumption during a standby state.

One example of fixing apparatuses employing a fixing belt includes a type in which a member (fixing flange, regulation member) that causes the fixing belt to slide while coming into contact with an end of the fixing belt is used as a member for regulating a movement of the fixing belt (endless belt) in a longitudinal direction thereof.

A fixing apparatus employing a fixing belt is generally includes members, such as a member provided in the fixing belt, and a member, such as a fixing flange, which frictionally slides on the fixing belt, in addition to the fixing belt. When the number of copies reach the set durability number, these components need to be replaced.

Japanese Patent Application Laid-Open No. 2011-197019 discusses a configuration in which a state where a fixing belt is inserted into a reinforcing member and a fixing flange is inserted into an end of the fixing belt is realized as a unit. Japanese Patent Application Laid-Open No. 2011-197019 also discusses a configuration in which the entire unit of the fixing belt is attached to the frame of the fixing apparatus or detached therefrom.

However, in the fixing apparatus discussed in Japanese Patent Application Laid-Open No. 2011-197019, in a state before the unit of the fixing belt is attached to the frame, the fixing flange is not provided with a retaining mechanism for the reinforcing member and the like. Accordingly, when an operator attempts to attach the unit of the fixing belt to the frame, the fixing flange may be unintentionally disengaged from the member in the fixing belt unit.

SUMMARY OF THE INVENTION

The present disclosure is directed to preventing a regulation member of a belt unit from being disengaged from a member provided within an endless belt.

According to a first aspect of the present disclosure, a belt unit for forming a heating nip portion configured to heat a toner image in cooperation with a rotary member facing the belt unit, includes an endless belt, a nip forming member provided along a longitudinal direction of the endless belt on an inner side of the endless belt and configured to contact to an inner surface of the endless belt for forming the heating nip portion, a regulation member configured to regulate a position of the endless belt in the longitudinal direction, and a snap-fit unit formed of the nip forming member and the regulation member and configured to regulate the regulation member from being disengaged from the nip forming member.

According to a second aspect of the present disclosure, an image heating apparatus includes a belt unit including an endless belt, an nip forming member provided along a longitudinal direction of the endless belt on an inner side of the endless belt and configured to contact to an inner surface of the endless belt for forming the heating nip portion, a regulation member configured to regulate a position of the endless belt in the longitudinal direction, a snap-fit unit formed of the nip forming member and the regulation member, the snap-fit unit being configured to regulate the regulation member from being disengaged from the nip forming member, a support unit configured to detachably support the belt unit, and a rotary member forming a heating nip portion in cooperation with the endless belt supported by the support unit, the heating nip portion being configured to heat a toner image.

Further features of the present disclosure will become apparent from the following description of exemplary embodiments with reference to the attached drawings.

DESCRIPTION OF THE EMBODIMENTS

Exemplary embodiments for carrying out the present disclosure will be described in detail below by way of example with reference to the drawings. However, the dimensions, materials, shapes, and relative arrangement of constituent components described in the exemplary embodiments may be suitably modified according the configuration and various conditions of the apparatus to which the present disclosure is applied, and the scope of the present disclosure is not intended to be limited to the following exemplary embodiments. Unless otherwise specified, various configurations described in the exemplary embodiments may be replaced with other known configurations within the scope of the present disclosure.

<Image Forming Apparatus>

Figure 4:
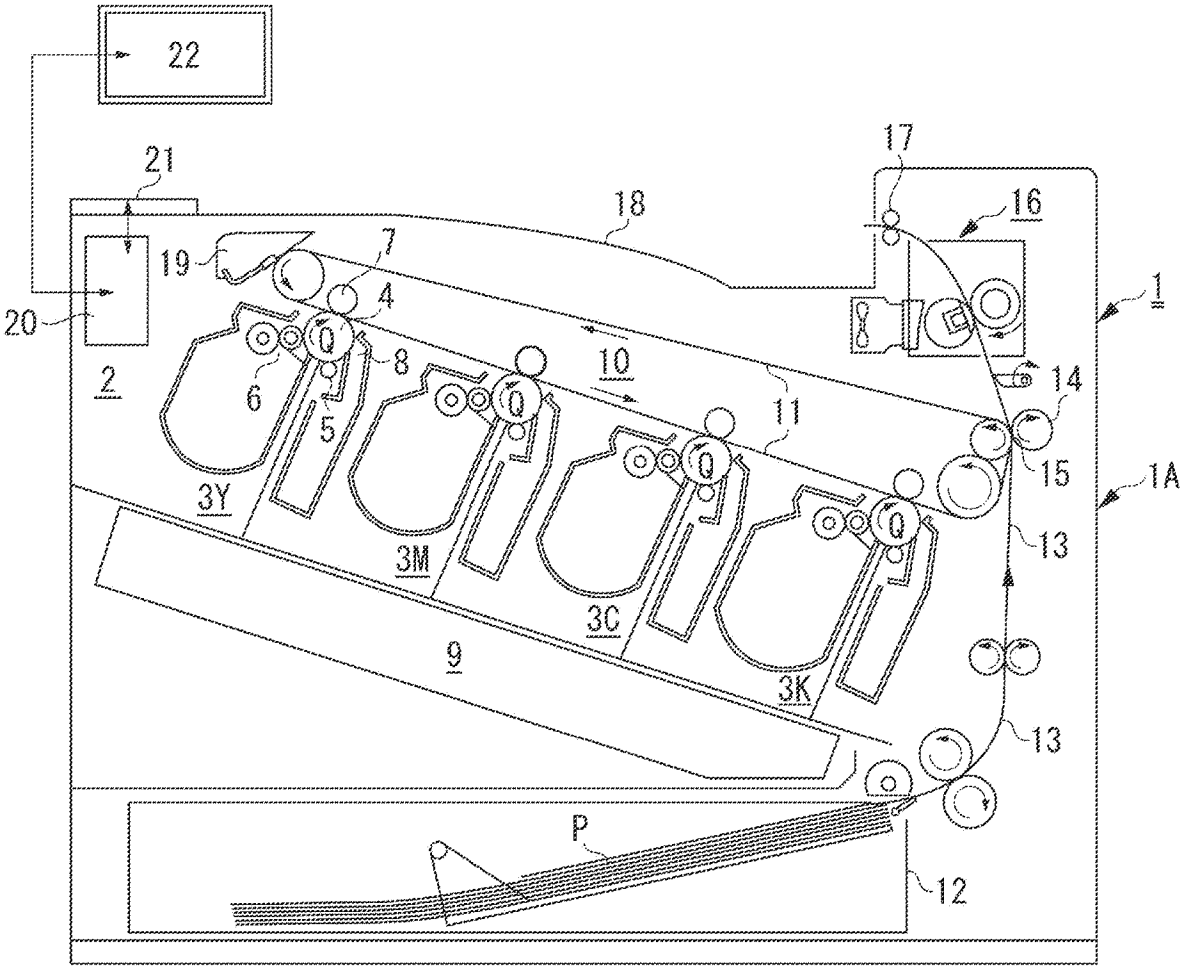
FIG. 4 is a schematic diagram illustrating a configuration of an example of an image forming apparatus.

FIG. 4 is a schematic configuration diagram illustrating an example of an image forming apparatus 1 on which a fixing apparatus 16 according to an exemplary embodiment is mounted. The image forming apparatus 1 is a full-color printer (hereinafter referred to as a printer) using an electrophotographic process. The printer 1 is capable of printing out an image by forming a toner image on a recording medium P based on an image signal input to a control unit (control circuit unit) 20 from an external device 22, such as an information terminal, such as a personal computer, or an image reader. The printer 1 includes an operation unit 21. The recording medium P is a recording medium (hereinafter referred to as a sheet) on which toner images can be formed. Examples of the recording medium P include plain paper, thick paper, overhead projector (OHP) sheets, coat paper, and label paper.

An image forming unit 2 that is provided in a printer main body (image forming apparatus main body) 1A and forms toner images on the sheet P includes four image forming mechanism units 3Y, 3M, 3C, and 3K that form toner images of four colors, i.e., yellow (Y), magenta (M), cyan (C), and black (K), respectively. The image forming mechanism units 3Y, 3M, 3C, and 3K are arranged in this order from the left side to the right side in FIG. 4. A laser scanner unit 9, which is an exposure device, is disposed below the image forming mechanism units 3Y, 3M, 3C, and 3K. An intermediate transfer belt unit 10 is disposed above the image forming mechanism units 3Y, 3M, 3C, and 3K.

The image forming mechanism units 3Y, 3M, 3C, and 3K have substantially the same electrophotographic process configuration, except for the color of toner (developer) to be used as described above. Each image forming mechanism unit includes an electrophotographic photosensitive drum 4, which is an image-bearing member, a charging roller 5, a developing unit 6, a primary transfer roller 7, and a drum cleaner 8. To simplify the illustration, illustration of reference signs to denote these devices in the image forming mechanism units is omitted, except for the image forming mechanism unit 3Y, i.e., in the image forming mechanism units 3M, 3C and 3K. The electrophotographic process and image formation operation in each image forming mechanism unit are known, and thus the descriptions thereof are omitted.

Toner images for the respective colors are superimposed at a predetermined location on a surface of a rotating intermediate transfer belt 11 of the intermediate transfer belt unit 10 and are primarily transferred onto the transfer belt 11 from the rotating drum 4 of each image forming mechanism unit. As a result, full-color superimposed unfixed toner images of four colors. i.e., Y, M, C, and K colors, are formed on the belt 11.

On the other hand, a sheet P is fed from a cassette 12, passes through a conveyance path 13, and is introduced into a secondary transfer nip portion 15, which is a pressure contact portion formed of the belt 11 and secondary transfer rollers 14, at a predetermined control timing. As a result, the four-color superimposed toner images formed in layers on the belt 11 are collectively and sequentially secondarily-transferred onto the sheet P. The sheet P is introduced into the fixing apparatus 16 and subjected to fixing processing for fixing the toner images. The sheet P which has passed through the fixing apparatus 16 is discharged onto a discharge tray 18 by a discharge roller pair 17. Transfer residual toner remaining on the belt 11 after the secondary transfer of the toner images onto the sheet P is removed from the surface of the belt 11 by a belt cleaner 19.

<Fixing Apparatus>

A front face (front surface) of the fixing apparatus 16 according to the present exemplary embodiment is a surface located on an entrance side for the sheet P, and a rear face (back surface) of the fixing apparatus 16 is a surface opposite to the front face. The rear face side of the fixing apparatus 16 corresponds to the side where an outlet for the sheet P is located. A left side of the fixing apparatus 16 is a left side (one end side, back side) when the fixing apparatus 16 is viewed from the front side, and a right side of the fixing apparatus 16 is a right side (the other end side, front side) when the fixing apparatus 16 is viewed from the front side. The top and bottom of the fixing apparatus 16 correspond to the top and bottom in the gravity direction. Upstream and downstream sides of the fixing apparatus 16 are upstream and downstream sides in a sheet conveyance direction (recording medium conveyance direction). A longitudinal direction (longer side direction) is a rotational axis direction or a bus direction of a rotary member, or a direction parallel to the rotational axis direction or the bus direction. A shorter side direction is a direction perpendicular to the longitudinal direction.

Figure 5:
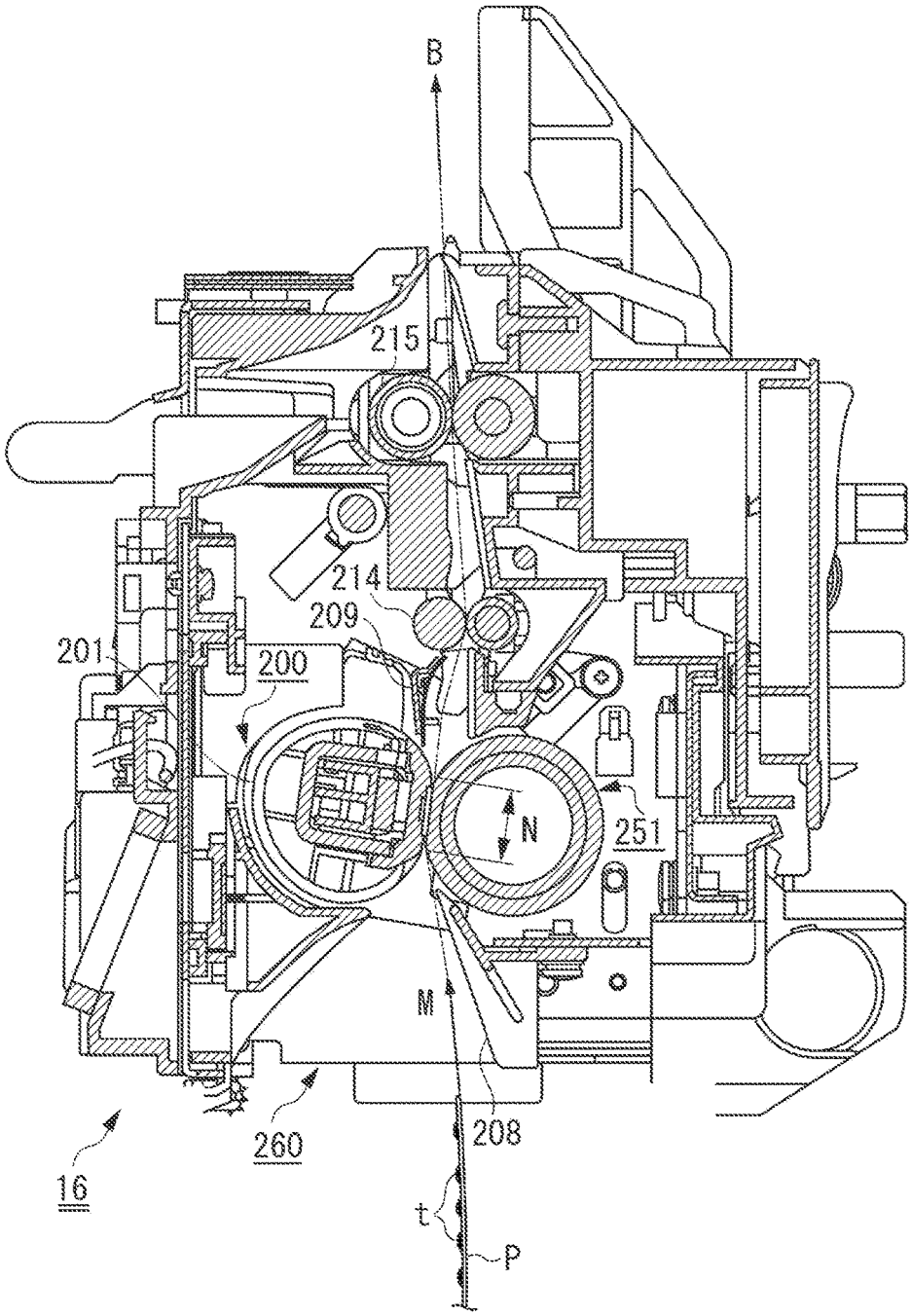
FIG. 5 is a cross-sectional view schematically illustrating a portion corresponding to a fixing apparatus in the image forming apparatus illustrated in FIG. 4.

FIG. 5 is a cross-sectional view schematically illustrating the fixing apparatus 16 in the printer 1 illustrated in FIG. 4. The fixing apparatus 16 according to the present exemplary embodiment is a belt (film) heating type image heating apparatus (on-demand fixing device (OMF)) that enables a reduction in start-up time and a reduction in power consumption.

The fixing apparatus 16 roughly includes a fixing belt unit (belt unit) 200 including a fixing belt 201 as a fixing member, a pressure roller (rotary member) 251, and a fixing frame (apparatus housing) 260 that accommodates these components. A pressure contact between the fixing belt 201 and the pressure roller 251 forms a nip portion (fixing nip portion, heating nip portion) N. The nip portion N is a portion that nips and conveys the sheet P bearing an unfixed toner image t and fixes the toner image t onto the sheet P with heat and pressure.

(1) Fixing Belt Unit

Figure 6:
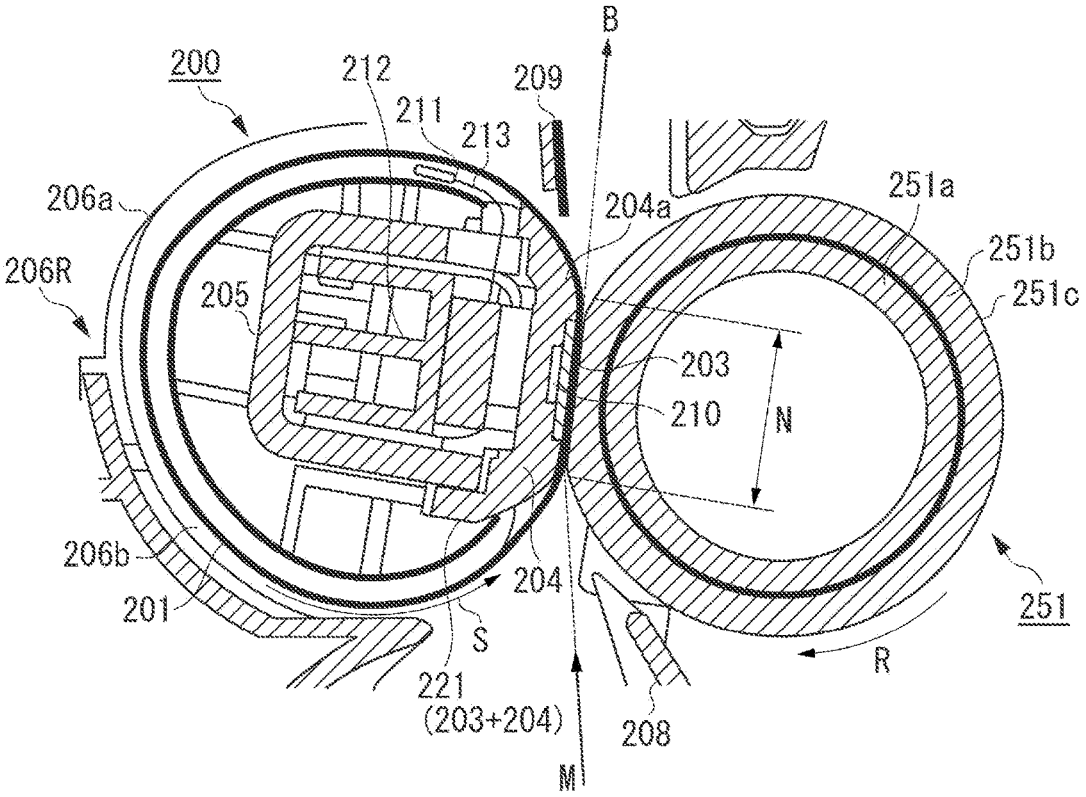
FIG. 6 is an enlarged view illustrating a portion corresponding to a belt unit and a pressure roller illustrated in FIG. 5.
Figure 7:
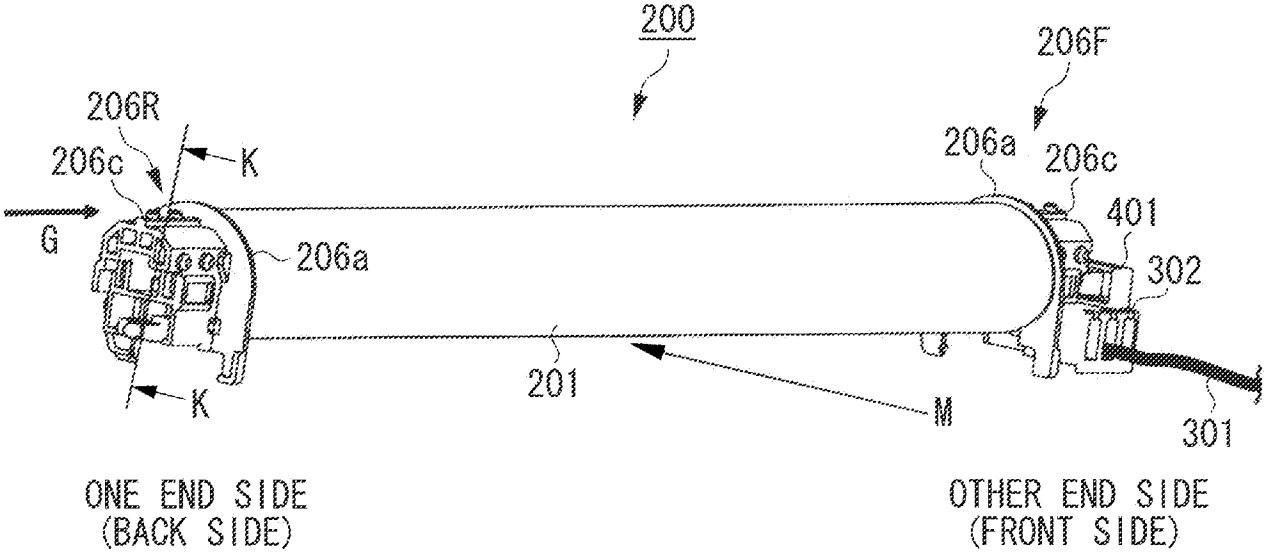
FIG. 7 is an appearance perspective view illustrating the belt unit.

FIG. 6 is an enlarged view illustrating a portion of the fixing belt unit (hereinafter referred to as a belt unit) 200 and the pressure roller 251 illustrated in FIG. 5. FIG. 7 is an appearance perspective view illustrating a single belt unit 200. The belt unit 200 is an assembly including the fixing belt 201, a ceramic heater 203, a heater holder 204, a stay 205, flange members (regulation members) 206 (R, F), a heater thermistor 210, a belt thermistor 211, and a thermistor holder 212.

1) Fixing Belt

The fixing belt (first rotary member, hollow rotary member, or an endless belt: hereinafter referred to as a belt) 201 is a thin endless belt having flexibility and heat resistance and serves as a heat-transfer member. In the present exemplary embodiment, the belt 201 is a composite layer belt formed by coating a phosphonoformic acid (PFA) tube on the outer peripheral surface of a belt base material which has an inner diameter of 30 mm and a thickness of 50 μm and is made of heat-resistant polyamide-imide. The belt 201 can be replaced with a metal sleeve.

2) Ceramic Heater

The ceramic heater (heating member: hereinafter referred to as a heater) 203 is a plate-like member elongated along the width direction of the belt 201, and the heater 203 generates heat by energization and the temperature of the ceramic heater 203 rises rapidly. Although not illustrated, the heater 203 includes, as a basic structure, an elongated ceramic substrate having a thin plate shape and a resistor layer that generates heat by energization. The resistor layer is provided along the longitudinal direction of the ceramic substrate surface. The heater 203 is a low-heat-capacity heater whose temperature rises entirely with rapid rising characteristics by energization of the resistor layer.

3) Heater Holder

The heater holder (hereinafter referred to as a holder) 204 is a member that fixes and supports the heater 203 and is elongated along the width direction of the belt 201. The holder 204 has a cross-section having a substantially semi-arc-like gutter shape. The heater 201 is fit into a slot which is formed along the longitudinal direction on the outer side of the holder 203 and is fixed with a heat-resistant adhesive. The holder 204 plays the role of backing up the heater 203 on the belt 201, pressing the nip portion N which is formed by a pressure contact with the pressure roller 251, and stabilizing the conveyance during rotation of the belt 201. The holder 204 needs to have slidability, heat resistance, and insulating characteristics. Liquid crystal polymer resin is used for the holder 204.

A combination of the heater 203 and the holder 204 is referred to as a nip forming member 221. On the downstream side of the holder 204 in the sheet conveyance direction, a protrusion 204*a* is provided so as to increase the width of the nip portion N and improve the separability of the sheet P from the belt 201.

4) Stay

The stay 205 is a reinforcing member that is disposed within the holder 203 to back up the holder 203. Accordingly, the stay 205 has rigidity and is elongated along the width direction of the belt 201. As a material for the stay 205, an electro galvanized steel sheet having a thickness of 2.3 mm is used, and the stay 205 has a U-shaped cross-section to ensure a sufficient strength. The stay 205 is pressed against the pressure roller 251 from the heater opposed surface side of the holder 204, which is made of a liquid crystal polymer material, thereby providing the heater 203 and the holder 204, i.e., the nip forming member 221, with a sufficient strength to ensure a pressure force at the nip portion N.

The flange members (fixing flanges) 206 (R, F), which are described below, are respectively attached to both end portions of the stay 205, thereby ensuring the strength of the belt unit 200.

5) Thermistor

Figure 9A:
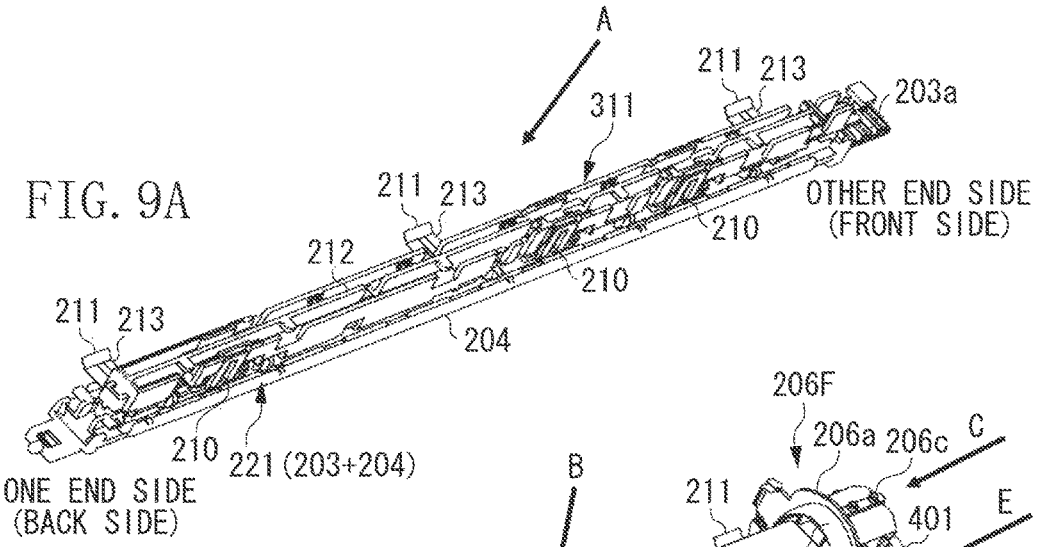
FIGS. 9A, 9B, and 9C are explanatory diagrams each illustrating a process of assembling the belt unit.

The thermistor holder 212 is disposed in a space portion surrounded by the holder 204 and the stay 205. The heater thermistor 210 for detecting and controlling the temperature of the heater 203, and the belt thermistor 211 for detecting the temperature of the belt 201 are attached to a plurality of predetermined positions on the holder 212 along the longitudinal direction of the holder 212 (FIG. 9A).

The heater thermistor 210 is fixed to a spring holder (not illustrated) and is pressed by a spring from the thermistor holder 212 and is thus pressed against the surface where the heater thermistor 201 and the belt 201 of the heater 203 do not slide with each other, with a pressure force of 1.96 N (0.2 Kgf). The belt thermistor 211 is elastically brought into contact with the inner surface of the belt 201 when the belt thermistor 211 is attached to a free end of a fixed plate spring 213 a base of which is fixed to the holder 212, and holds a state where the belt thermistor 211 is in contact with the inner surface of the belt 201 in accordance with the movement of the rotating belt 201.

6) Flange Member

The belt 201 includes an assembly of the members 203 to 205 and 210 to 213 as an inside member and is loosely fit (extrapolated) onto the inside member. In the present exemplary embodiment, the inner peripheral length of the belt 201 is set to be 102% of the outer peripheral length of the inside member, and the belt 201 is slightly loosely fit onto the inside member.

The both ends of each of the nip forming member 221 and the stay 205, which are the inside members of the belt 201, project outward by a predetermined extent from opening portions at the both ends of the belt 201. The flange members 206 (R, F), which are provided on one end side and the other end side, respectively, are attached to (fit into) projecting portions formed on the one end side and the other end side, respectively.

Each of the flange members 206 (R, F) (regulation members) is a regulation member that regulates the movement of the belt 201 in the longitudinal direction thereof and the shape of the belt 201 in the circumferential direction thereof. As a material for the flange members 206 (R, F), liquid crystal polymer resin having heat resistance and slidability is used. The flange members 206 (R, F) each include a flange portion (flange seat portion, first regulating portion) 206*a*, a belt guide portion 206*b* (FIGS. 6 and 9B) which is provided within the flange portion 206*a*, and a pressed portion 206*c* which is provided outside the flange portion 206*a*.

The belt 201 is located between the opposed flange portions 206*a* of the flange member 206R located on one end side and the flange member 206F located on the other end side (FIG. 7). Each flange portion 206*a* is a portion that receives an edge surface at an end of the belt 201 and regulates the movement of the belt 201 in a thrust direction thereof. The belt guide portion 206*b* is a portion that supports the inner peripheral surface of the belt 201 at an end in the longitudinal direction thereof to retain the cylindrical shape of the belt 201 (a portion that stabilizes the rotational trajectory of the belt 201). The pressed portion 206*c* is a portion that receives a pressing force from a pressure member (not illustrated).

(2) Pressure Roller

The pressure roller (pressure member, opposed member, rotary member) 251 includes a core metal 251*a* that is made of mild steel, a silicon rubber elastic material layer 251*b* that is concentrically formed and coated on the outer periphery of the core metal 251*a* in a roller shape, and a releasable layer (surface layer) 251*c* that is made of a PFA tube coated on the outer periphery of the elastic material layer 251*b*. In the present exemplary embodiment, the pressure roller 251 is an elastic roller having a configuration as described above and an outer diameter of 30 mm.

In the pressure roller 251, one end side and the other end side of the core metal 251*a* are rotatably supported through bearings (not illustrated), respectively, between side plates respectively located on one end side and the other end side of the fixing frame 260.

(3) Pressing of Flange Member

The belt unit 200 is arranged substantially in parallel to the pressure roller 251 so that the side of the belt unit 200 that is located on the heater 203 side is opposed to the pressure roller 251 between the side plates respectively located on one end side and the other end side of the fixing frame 260. The pressed portions 206*c* of the flange members 206 (R, F) located on one end side and the other end side, respectively, engage with a guide slit 260*a* (FIG. 2) which is formed symmetrically to the side plates located on one end side and the other end side, respectively, in such a manner that the pressed portions 206*c* are slidably movable in the pressure roller direction.

The pressed portions 206*c* of the flange members 206 (R, F) located on one end side and the other end side, respectively, receive a predetermined pressing force in the pressure roller direction from the pressure member (not illustrated). With this configuration, as illustrated in FIG. 6, the nip forming member 221 is pressed against the pressure roller 251 through the belt 201. Thus, the belt 201 is pressed against the pressure roller 251 by the nip forming member 221 against the elasticity of the elastic layer 251*b* of the pressure roller 251, and the nip portion N having a predetermined width is formed in the sheet conveyance direction between the belt 201 and the pressure roller 251.

(4) Fixing Operation

Figure 8:
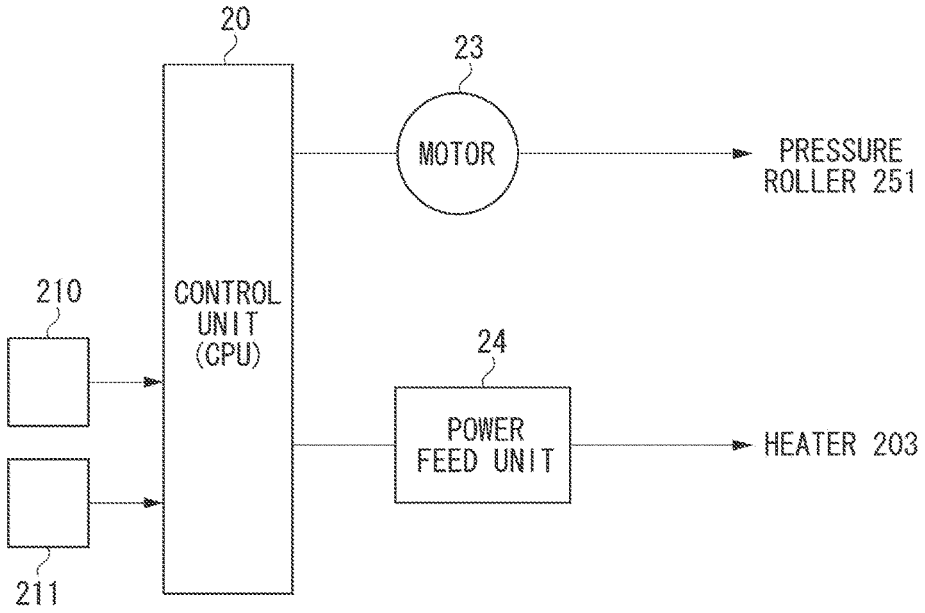
FIG. 8 is a block diagram illustrating a control system.

The control unit 20 rotationally drives the pressure roller 251 as a drive rotary member at a predetermined circumferential velocity in a clockwise direction indicated by an arrow R in FIG. 6 based on a print start signal. Referring to FIG. 8, a motor 23 serves as a drive source of a drive mechanism (not illustrated) for the pressure roller 251 and is controlled by the control unit 20.

When the pressure roller 251 is rotationally driven, a frictional force with the pressure roller 251 generates a rotary torque to act on the belt 201 at the nip portion N. With this rotary torque, the inner surface of the belt 201 is rotated in a counterclockwise direction indicated by an arrow S in FIG. 6 around the nip forming member 221 and the stay 205, while coming into close contact and sliding with a part of the heater 203 and the holder 204 of the nip forming member 221 at the nip portion N. The rotational circumferential velocity of the belt 201 substantially matches the rotational circumferential velocity of the pressure roller 251.

The inner surface of the belt 201 and the nip forming member 221 slide with each other (come into slide contact with each other), thereby generating a sliding resistance. Fluorine grease having heat-resistant characteristics is coated on a sliding portion between the nip forming member 221 and the belt 201 so that the sliding resistance is prevented from being extremely increased and is set at a constant value. The pressure roller 251 rotates against the sliding resistance and conveys the sheet P.

The control unit 20 starts energization of the heater 203 from a power feed unit 24 (FIG. 8). A power feed path from the power feed unit 24 to the heater 203 is formed through a drawer connector (not illustrated) connecting the printer main body 1A and the fixing apparatus 16, a wire (power feed cable) 301, and a power feed connector (AC connector) 302. The power fed through the power feed path allows the temperature of the heater 203 to rapidly rise. The heater thermistor 210 feeds back a signal corresponding to the temperature of the heater 203 to the control unit 20. The belt thermistor 211 also feeds back a signal corresponding to the temperature of the belt 201 to the control unit 20.

The control unit 20 controls the power to be supplied to the heater 203 from the power feed unit 24 so that the temperature of the heater 203 is adjusted to rise to a predetermined target set temperature based on information about detected temperatures from the thermistors 210 and 211.

In the state of the fixing apparatus 16 described above, the sheet P on which the unfixed toner image t is formed by the image forming unit 2 (FIG. 4) is guided to the fixing apparatus 16 from a direction indicated by an arrow M in FIG. 5, and is guided to the nip portion N by an inlet guide 208 and nipped and conveyed by the nip portion N. In the process in which the sheet P is nipped and conveyed by the nip portion N, heat from the heater 203 is applied to the sheet P through the belt 201. The unfixed toner image t is melted by the heat from the heater 203, and receives the pressure applied to the nip portion N. In this way, the toner image t is fixed onto the sheet P.

The sheet P which has passed through the nip portion N is conveyed in a direction indicated by an arrow B by a plurality of conveyance roller pairs 214 and 215, which are provided in the fixing apparatus 16, and is discharged to the outside of the fixing apparatus 16. A separating plate 209 is provided at a position on the downstream side of the nip portion N in the sheet conveyance direction so that the sheet P can be smoothly separated from the belt 201 at a sheet outlet portion of the nip portion N.

(5) Replacement of Components of Fixing Apparatus

In the fixing apparatus 16, the belt unit 200, the pressure roller 251, and the like are assembled by a predetermined operation procedure so as to be detachable from the fixing frame 260. For example, when the durability life of the belt 201 is reached, or when there is a need to replace the belt 201 or another component due to an accidental trouble, a replacement work for a required component, such as the belt, or the entire belt unit 200 is performed by a service engineer.

A deterioration in durability of the belt 201 and the pressure roller 251, which form the nip portion N, due to sheet passing makes it difficult to output an excellent image. Accordingly, the member that is recommended to be replaced when a cumulative number of passing sheets has reached a predetermined number is treated as a periodic replacement component. The replacement work is periodically carried out by the service engineer. In the present exemplary embodiment, the belt 201 and the pressure roller 251 are replaced every time 300,000 A4-horizontal-size sheets are passed.

Therefore, since a maintenance work for the fixing apparatus 16 is periodically carried out after the fixing apparatus 16 is detached from the printer main body 1A, the fixing apparatus 16 is detachably (attachably/detachably) fixed to a predetermined attaching portion of the printer main body 1A with screws. The service engineer opens the printer main body 1A by a predetermined operation procedure and removes the screws from the fixing apparatus 16, which is fixed to the printer main body 1A with the screws, thereby taking the fixing apparatus 16 out of the printer main body 1A.

The belt unit 200 and the pressure roller 251 are detached from the detached fixing fame 260 of the fixing apparatus 16 by a predetermined operation procedure. Then, in the belt unit 200, replacement of the belt 201 or another component is performed by a predetermined operation procedure. In some cases, replacement of the entire belt unit 200 is performed. The belt unit 200 in which a component, such as the belt 201, has been replaced, or a replaced component, such as a new belt unit 200 or a new pressure roller 251, is re-assembled to the fixing frame 260.

The fixing apparatus 16 in which the component has been replaced is re-attached to a predetermined attaching portion of the printer main body 1A by a predetermined operation procedure and is fixed to the printer main body 1A with screws, and the printer main body 1A is closed. Thus, the printer 1 is restored to a print operable state.

(6) Assembly of Belt Unit

A state where the belt unit 200 is assembled will be described with reference to FIGS. 9A to 9C and 7.

1) As illustrated in FIG. 9A, a positioning portion of a thermistor unit 311 and a positioning portion of the nip forming member 221 are fit and combined from a direction indicated by an arrow A. As described above, the nip forming member 221 is formed by attaching the heater 203 to the holder 204 with a heat-resistant adhesive. In FIG. 9A, the heater 203 is located at the opposite side of the thermistor unit 311 of the holder 204, and thus the heater 203 is hidden.

The thermistor unit 311 is assembled by attaching the heater thermistor 210, the belt thermistor 211, and a thermoswitch (not illustrated) to the thermistor holder 212. The illustration of bundle wires of the thermistors and the like is omitted.

Figure 9B:
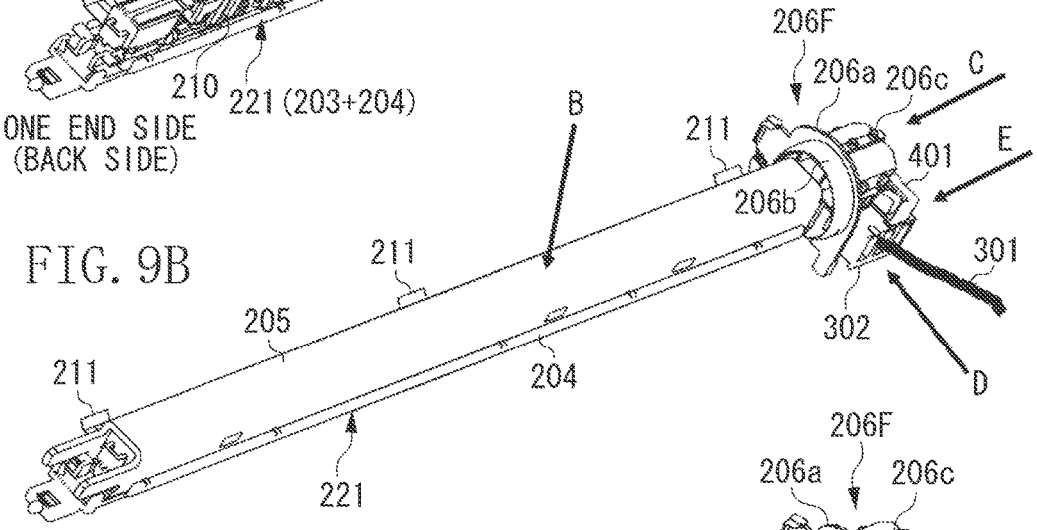

2) The stay 205 is attached to the assembly illustrated in FIG. 9A. More specifically, as illustrated in FIG. 9B, the stay 205 is attached to the assembly from the direction indicated by the arrow B by fitting the positioning portions provided on the stay 205 and the holder 204, respectively, so as to cover the thermistor unit 311. The flange member 206F located on the other end side (front side) is attached to protruding portions on the other end side of the nip forming member 221 and the stay 205, which are the inside members of the belt 201, from a direction indicated by an arrow C.

The AC connector 302 for supplying power to the heater 203 is attached to the protruding portion on the other end side of the nip forming member 221 from a direction indicated by an arrow D. A power feed unit 203*a* (FIG. 9A) for the heater 203 is disposed on the protruding portion on the other end side of the nip forming member 221. Accordingly, the AC connector 302 is attached to the protruding portion on the other end side of the nip forming member 221, thereby electrically connecting the AC connector 302 and the heater 203. Further, a connector stopper 401 for preventing the movement of the AC connector 302 is attached from a direction indicated by an arrow E so as to couple the flange member 206F and the AC connector 302.

In a state illustrated in FIG. 9B, fluorine-based grease is coated on the surface of the heater 203 and a belt sliding portion of the holder 204. The heater 203 and the holder 204 constitute the nip forming member 221.

Figure 9C:
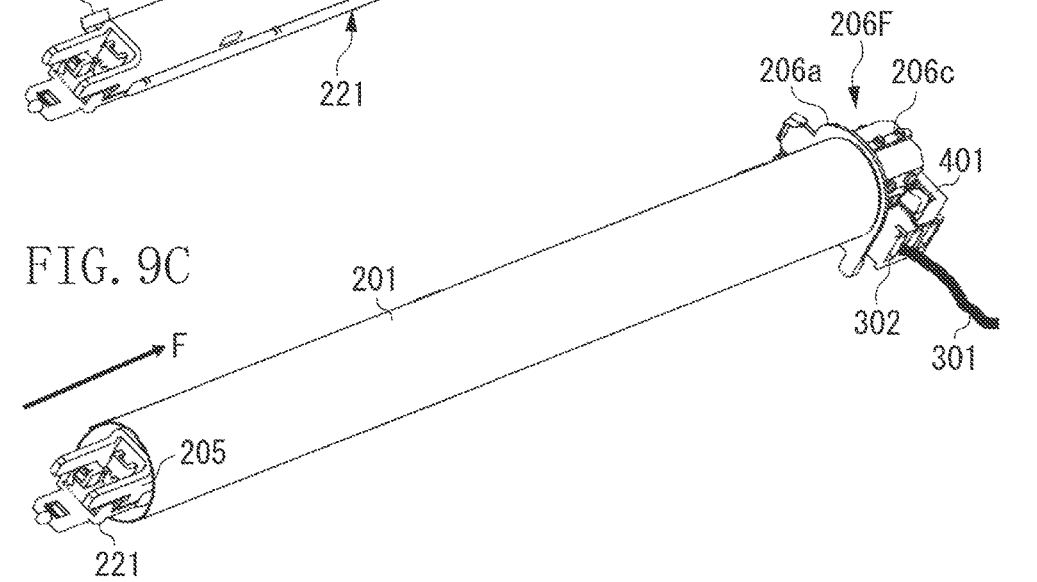

3) The belt 201 is attached to the assembly illustrated in FIG. 9B. More specifically, as illustrated in FIG. 9C, the belt 201 is fit onto the assembly illustrated in FIG. 9B in a direction indicated by an arrow F from one end side of the assembly. The belt 201 is then moved until an end face (edge surface) on the other end side of the belt 201 contacts the flange portion 206*a* of the flange member 206F. The work for inserting the belt 201 is carefully performed so as to prevent any scratches, nicks, or the like from being caused on the belt 201.

4) The flange member 206R located on one end side (back side) is attached to the assembly illustrated in FIG. 9C. More specifically, as illustrated in FIG. 7, the flange member 206R is attached to the protruding portions of the nip forming member 221 and the stay 205, which are the inside members of the belt 201, on the one end side, from a direction indicated by an arrow G. The work for attaching the flange member 206R is carefully performed so as to prevent the flange member 206R from making any scratches, nicks, or the like on the belt 201 or the like.

The belt unit 200 is assembled by the procedure as described above. The belt unit 200 is disassembled by a procedure reverse to the procedure described above.

(7) Disengagement Prevention Structure of Flange Member

Figure 1:
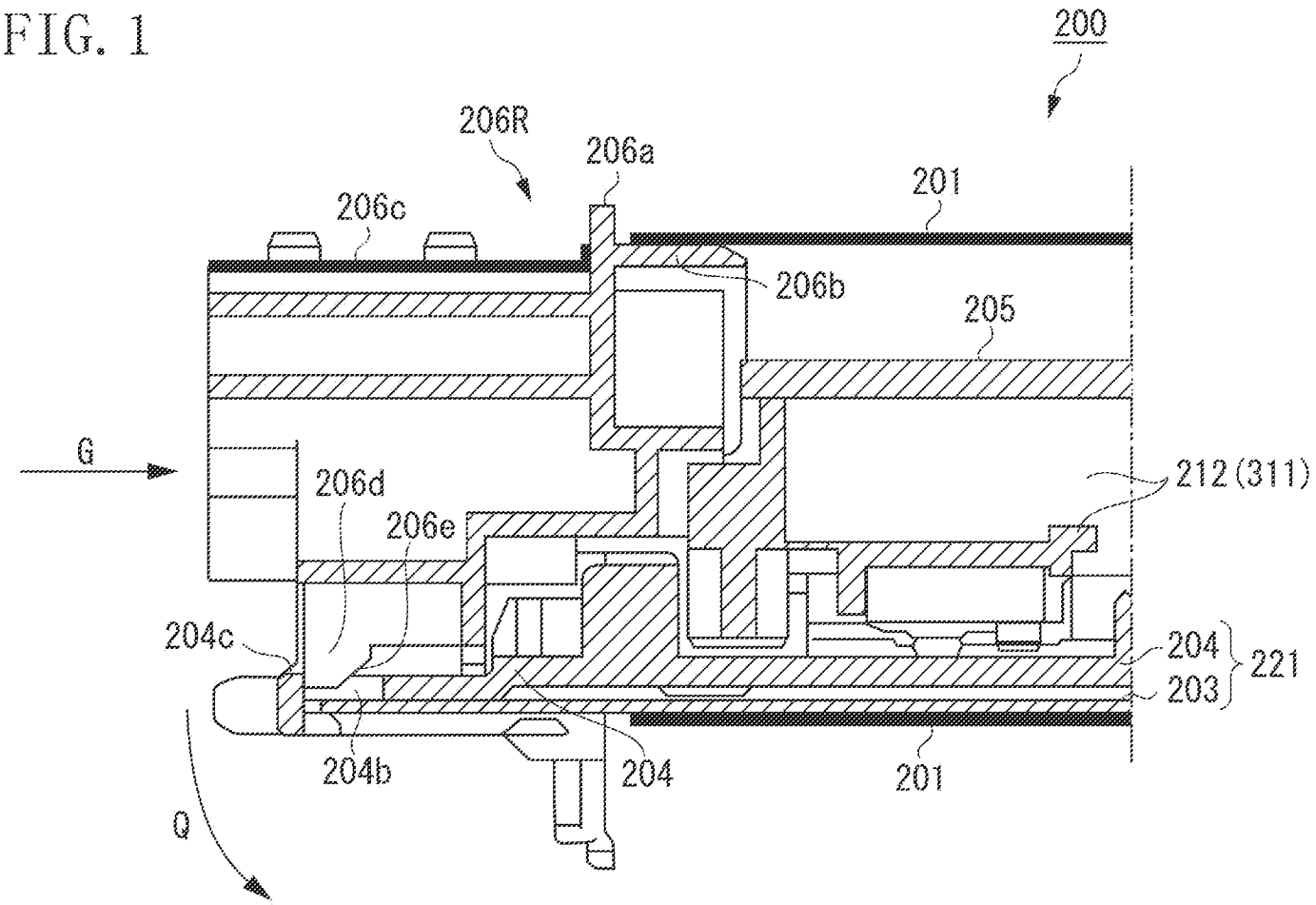
FIG. 1 is an explanatory diagram illustrating an engagement of a flange member with a heater holder.

FIG. 1 is a cross-sectional view taken along a line K-K of a portion corresponding to the flange member 206R located on one end side of the belt unit 200 illustrated in FIG. 7 and illustrates a disengagement prevention structure for preventing disengagement of the flange member 206R from the belt unit 200 in the present exemplary embodiment. The disengagement prevention structure of the flange member 206F located on the other end side is the same as that of the flange member 206R, and thus the disengagement prevention structure of the flange member 206R located on one end side illustrated in FIG. 1 will be described below as a representative example.

Figure 2:
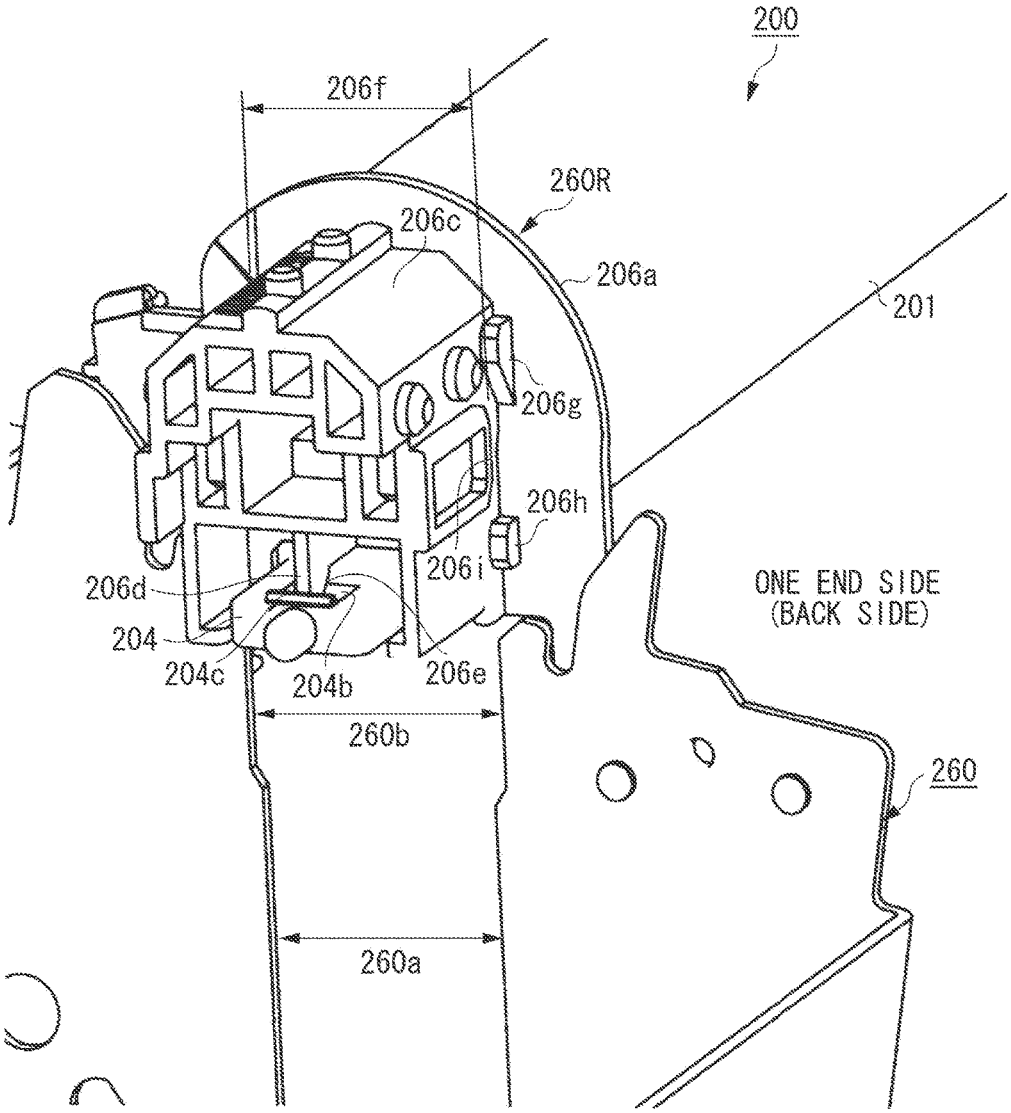
FIG. 2 is a diagram schematically illustrating assembling of a belt unit to a frame.

In the present exemplary embodiment, the flange member 206R is detachably attached to the protruding portions of the nip forming member 221 and the stay 205, which are the inside members of the belt 201, on the one end side. Referring to FIGS. 1 and 2, a rib-like protruding portion (claw portion) 206*d* is formed integrally with the flange member 206R. A tapered portion 206*e* as illustrated in FIGS. 1 and 2 is formed in an advancing direction G in which the protruding portion 206*d* is assembled to the belt unit 200.

On one end of the holder 204, which is a constituent member of the nip forming member 221, a hole 204*b* into which the protruding portion 206*d* of the flange member 206R is fit is formed. The hole 204*b* is a hole that is formed in the flange member 206R so as not to interfere with the protruding portion 206*d* when the flange member 206R is assembled to a normal position on one end of the holder 204. On an upstream side of the hole 204*b* in the advancing direction G in which the flange member 206R is assembled to one end of the holder 204, a protruding portion 204*c* having a tapered shape protrudes toward the flange 206R.

When the flange member 206R is assembled to the normal position on one end of the holder 204, the protruding portion 206*d* protruding from the flange member 206R and the protruding portion 204*c* protruding from the holder 204 engage with each other in the height direction. This configuration prevents the flange member 206R from being disengaged from the one end of the holder 204, i.e., the belt unit 200.

In the case of assembling the flange member 206R to the one end of the holder 204, the tapered portion 206*e* that is provided on the protruding portion 206*d* of the flange member 206R and the protruding portion 204*c* that protrudes from the one end of the holder 204 and has a tapered shape engage with each other. During this engagement, when the protruding portion 206*d* climbs over the protruding portion 204*c*, the one end of the holder 204 can be deformed using the elasticity of the holder 204 in a direction indicated by an arrow Q.

When the flange member 206R advances to the normal position on one end of the holder 204, the one end of the holder 204 that is temporarily deformed is restored to the original position due to the elasticity of the holder 204 itself. In this way, the configuration as illustrated in FIG. 1 prevents the flange member 206R from being disengaged from the one end of the holder 204, i.e., the belt unit 200, as described above.

In other words, a so-called snap-fit (engaging portion) in which the protruding portion 206*d* is fit and fixed to the hole 204*b* and the protruding portion 204*c* by the elasticity of the material is performed. The protruding portion 206*d* may be disposed on the holder 204 side, and the hole 204*b* and the protruding portion 204*c* may be disposed on the flange member 206R. In the present exemplary embodiment, the term "engagement" refers to a state where the protruding portion 204*c* is fit into the hole 204*b*. Thus, the hole 204*b* may be formed with a size a little larger than the protruding portion 204*c*, and a certain clearance is provided in the state where the hole 204*b* is fit to the protruding portion 204*c*. In this state, the disengagement of the flange member 206R from the holder 103 is regulated.

The configuration described above is summarized below. Each of the protruding portion 206*d*, the hole 204*b*, and the protruding portion 204*c* is a regulating portion that is arranged relatively to the flange member 206R and the holder 204 to regulate the disengagement of the flange member 206R from the holder 204. This regulating portion can release the regulation when the flange member 206R or the holder 204 is deformed against the elasticity. Releasing the regulation facilitates the detachment of the flange member 206R from the belt unit 200.

The attachment of the flange member 206F located on the other end side to the other end of the holder 204, the disengagement prevention structure, and the detachment of the flange member 206F located on the other end side from the other end of the holder 204 are similar to those of the flange member 206R located on one end side described above.

In the belt unit 200, the movement of the belt 201 in the longitudinal direction is regulated by the flanges 206 (R, F) located on one end side and the other end side, respectively, and the flanges 206 (R, F) are fixed in a movable state with a certain clearance provided for the stay 205 and the holder 204.

In a state where the belt unit 200 is not set in the frame 260, the regulating portions 206*d*, 204*b*, and 204*c* are provided to prevent the flange members 206 (R, F) from being disengaged from the unit 200 with a clearance in the longitudinal direction of the belt unit 200. The regulating portions 206*d*, 204*b*, and 204*c* are disposed in the flange members 206 (R, F), and the holder 204, which is the inside member of the belt 201, and the flange members 206 (R, F) or the holder 204 has flexibility.

Therefore, the configuration described above facilitates the work for attaching the flange members 206 (R, F) to the belt unit 200, or detaching the flange members 206 (R, F) from the belt unit 200. The regulating portions (engaging portions) 206*d*, 204*b*, and 204*c*, which are provided in both components engage with each other, thereby regulating the movement of the flange members 206 (R, F) in the longitudinal direction of the belt unit 200. This configuration prevents the flange members 206 (R, F) from being unexpectedly disengaged from the belt unit 200 in a state where the belt unit 200 is set in the frame 260 or detached from the frame 260.

Thus, it is also possible to prevent a trouble, such as a damage or breakage, from being caused on the components, while facilitating the work for replacing the components of the belt unit 200.

Further, the regulating portions (engaging portions) 206*d*, 204*b*, and 204*c* are not components that are separated from the flange portion 206 and the holder 204, but instead are formed integrally with the flange members 206 (R, F) and the holder 204. This configuration reduces the possibility that the regulating portions may be lost even when the regulating portions (engaging portions) are unintentionally detached by an operator such as a service engineer.

In the present exemplary embodiment, as illustrated in FIG. 7, in the belt unit 200, the AC wire 301 and the AC connector 302 for supplying power to the heater 203 are attached only to the flange member 206F located on the other end side. In other words, the power feed unit 203*a* (FIG. 9A) for the heater 203 is disposed on one end side of the nip forming member 221 in the longitudinal direction, and the AC wire 301 is disposed at the power feed unit 203. This configuration is referred to as one-side power feeding.

One-side power feeding is enabled by providing a coupling portion to a heater pattern for heat generation (not illustrated) which is provided on the heater 203 for one-side power feeding. The detailed description thereof is herein omitted. One-side power feeding facilitates the attachment and detachment of the flange member 206R to which no power is fed, and thus an advantageous effect of simplifying the work for replacing the belt 201 is obtained.

In addition to this advantageous effect, the provision of the regulating portions (engaging portions) 206*d*, 204*b*, and 204*c* on one end of each of the flange member 206R and the holder 204 prevents the flange member 206R from being unexpectedly disengaged from the belt unit 200. This eliminates a trouble to cause scratches, nicks, or the like on the belt 201 during operation.

(8) Positioning of Flange Member

Positioning of the flange members 206 (R, F), which are respectively provided on one end side and the other end side of the belt unit 200, with respect to the longitudinal direction of the belt unit 200 is performed by incorporating the belt unit 200 into the fixing frame 260. Next, details of the positioning will be described with reference to FIGS. 2 and 3.

FIG. 2 illustrates details of positioning of the flange member 206R on one end side with respect to the fixing frame 260. The positioning of the flange member 206F on the other end side with respect to the fixing frame 260 is similar to that of the flange member 206R, and thus the positioning of the flange member 206R on one end side illustrated in FIG. 2 will be described below as a representative example.

A side plate on one end side of the fixing frame 260 is provided with the slit 260*a* for positioning the flange member 206R on one end side of the belt unit 200 in the sheet conveyance direction. In the present exemplary embodiment, the width of the slit 260*a* is 20+0.09/0 mm. On the other hand, a width 206*f* of the pressed portion 206 of the flange member 206R in the sheet conveyance direction is 20−0.02/−0.09 mm. The pressed portion 206*c* having the width 206*f* is inserted into the slit 260*a* having the width described above and engages with the slit 260*a*. To facilitate insertion of the flange member 206R into the fixing frame 260, a width 260*b* of an introducing portion of the pressed portion of the fixing frame 260 is 22 mm.

Positioning of the flange member 206R in the longitudinal direction is performed in such a manner that protruding portions 206*g*, 206*h*, and 206*i*, which are provided on the flange member 206R, alternately protrude, are set to a width of 1.4±0.05 mm, and are fit to a sheet metal with a thickness of 1.2 mm of the fixing frame 260. Protrusions similar to the protruding portions 206*g*, 206*h*, and 206*i* are also present on the opposite side of the flange member 206R.

The relationship and configuration of the side plate on the other end side of the fixing frame 260 and the flange member 206F on the other end of the belt unit 200 are also similar to those of the flange member 206R on one end side described above.

Between the side plates respectively provided on one end side and the other end side of the fixing frame 260, the belt unit 200 is arranged substantially in parallel to the pressure roller 251 so that the side of the belt unit 200 that is located on the heater 203 side is opposed to the pressure roller 251. Further, the pressed portions 206*c* of the flange members 206 (R, F), which are provided on one end side and the other end side of the belt unit 200, respectively, engage with the guide slit 260*a* which is formed symmetrically to the side plates respectively formed on one end side and the other end side of the fixing frame 260. Thus, the flange members 206 (R, F) respectively provided on one end side and the other end side of the belt unit 200 are positioned in the longitudinal direction of the belt unit 200.

The pressed portions 206*c* of the flange members 206 (R, F) respectively provided on one end side and the other end side receive a predetermined pressing force in the pressure roller direction by the pressure member (not illustrated). Thus, as illustrated in FIG. 6, the nip forming member 221 is pressed against the pressure roller 251 through the belt 201. Thus, the belt 201 is pressed against the pressure roller 251 by the nip forming member 221 against the elasticity of the elastic layer 251*b* of the pressure roller 251, thereby forming the nip portion N having a predetermined width in the sheet conveyance direction between the belt 201 and the pressure roller 251.

Figure 3:
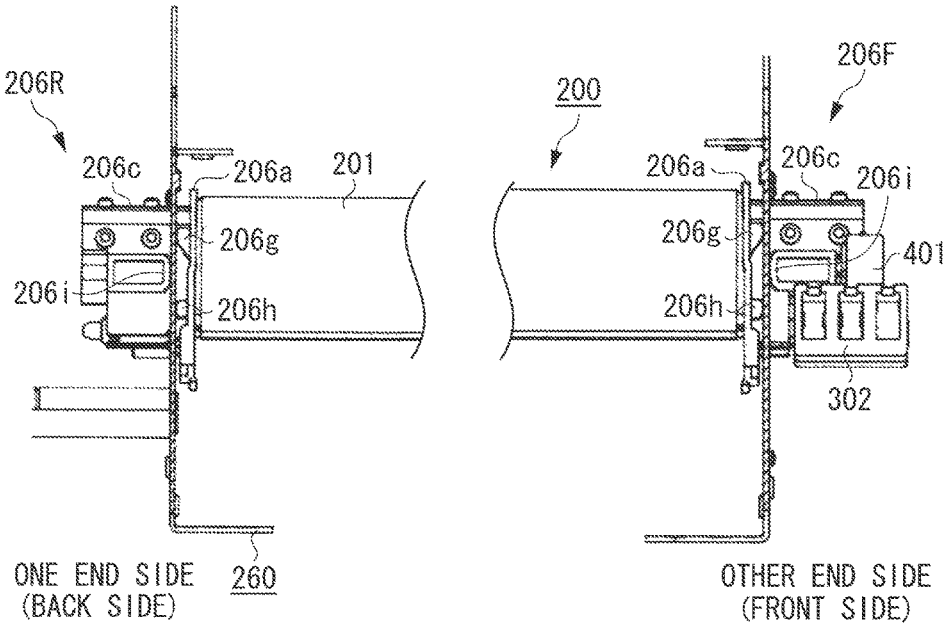
FIG. 3 is a diagram illustrating a state where the belt unit is assembled to the frame, in which a middle portion is omitted.

FIG. 3 is a partially omitted view illustrating a state where the belt unit 200 is incorporated into the fixing frame 260 in the longitudinal direction and the flange member 206R and the flange member 206F engage with the side plates respectively provided on one end side and the other end side of the fixing frame 260.

As described above, the belt unit 200 is formed with the one-side power feeding configuration and the flange member 206R and the holder 204 are provided with the engaging portions 206*d* and 204*c*. With this configuration, the work for attaching the flange member 206R where the AC connector 302 is not attached, to the belt unit 200, and detaching the flange member 206R therefrom is simplified. In addition, the flange member 206R is prevented from being unexpectedly disengaged from the belt unit 200, and thus an advantageous effect of improving the reliability of the work while preventing a trouble, such as scratches and nicks, from being caused on the belt unit is obtained.

<<Other Features>>

(1) As the fixing apparatus 16, an apparatus that heats and fixes the unfixed toner image t formed on the recording medium has been described above by way of example. However, the present disclosure is not limited to this. For example, an apparatus that increases the gloss (glossiness) of an image by heating and re-fixing a toner image temporarily fixed onto a recording medium (this apparatus is also referred to as a fixing apparatus) may also be used.

(2) The heating member that heats the belt 201 for heating a toner image formed on a recording medium is not limited to the ceramic heater 203. An apparatus having a configuration using an internal heating type or external heating type heater such as an electromagnetic induction heating unit, a halogen heater, an infrared lamp, or a nichrome wire heater can also be used. An apparatus having a configuration in which the pressure roller 251 is provided with a heating member that heats the pressure roller 251 can also be used.

(3) The image forming apparatus is not limited to a full-color image forming apparatus of an electrophotographic method according to the exemplary embodiment, but instead an image forming apparatus that forms monochromatic images may be used. The image forming apparatus is not limited to the image forming apparatus of the electrophotographic method, but instead an image forming apparatus that forms toner images by a direct method or a transfer method by using another method, such as an electrostatic recording method or a magnetic recording method.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2017-070484, filed Mar. 31, 2017, and No. 2018-019218, filed Feb. 6, 2018, which are hereby incorporated by reference herein in their entirety.

What is claimed is:

1. A belt unit for forming a heating nip portion configured to heat a toner image in cooperation with a rotary member facing the belt unit, the belt unit comprising:

an endless belt;

a nip forming member provided along a longitudinal direction of the endless belt on an inner side of the endless belt and configured to contact to an inner surface of the endless belt for forming the heating nip portion;

a regulation member configured to regulate a position of the endless belt in the longitudinal direction; and a snap-fit unit formed of the nip forming member and the regulation member and configured to regulate the regulation member from being disengaged from the nip forming member.

2. The belt unit according to claim 1, wherein the regulation of the snap-fit unit is releasable when the nip forming member is deformed against an elasticity of the nip forming member.

3. The belt unit according to claim 1, wherein the regulation of the snap-fit unit is releasable when the regulation member is deformed against an elasticity of the regulation member.

4. The belt unit according to claim 1, wherein the nip forming member includes a heater.

5. The belt unit according to claim 1, wherein the belt unit includes a heater on the inner side of the endless belt, and wherein a power feed unit of the heater is provided at an end portion opposite to a side where the regulation member is provided in a longitudinal direction of the endless belt.

6. The belt unit according to claim 1, wherein the snap-fit unit has a hole formed in the nip forming member, and the regulation member is provided with a claw portion to engage with the hole.

7. The belt unit according to claim 1, wherein the snap-fit unit has a hole formed in the regulation member, and the nip forming member is provided with a claw portion to engage with the hole.

8. The belt unit according to claim 1, wherein the regulation member includes a guide unit located on the inner side of the endless belt and configured to guide the endless belt in a circumferential direction.

9. An image heating apparatus comprising:

a belt unit including an endless belt;

a nip forming member provided along a longitudinal direction of the endless belt on an inner side of the endless belt and configured to contact to an inner surface of the endless belt for forming a heating nip portion;

a regulation member configured to regulate a position of the endless belt in the longitudinal direction;

a snap-fit unit formed of the nip forming member and the regulation member, the snap-fit unit being configured to regulate the regulation member from being disengaged from the nip forming member;

a support unit configured to detachably support the belt unit; and a rotary member forming the heating nip portion in cooperation with the endless belt supported by the support unit, the heating nip portion being configured to heat a toner image.

10. The image heating apparatus according to claim 9, wherein regulation of the snap-fit unit is releasable when the nip forming member is deformed against an elasticity of the nip forming member.

11. The image heating apparatus according to claim 9, wherein regulation of the snap-fit unit is releasable when the regulation member is deformed against an elasticity of the regulation member.

12. The image heating apparatus according to claim 9, wherein the nip forming member includes a heater.

13. The image heating apparatus according to claim 9, wherein the belt unit includes a heater provided on the inner side of the endless belt, and wherein a power feed unit of the heater is provided at an end opposite to a side where the regulation member is provided in a longitudinal direction of the endless belt.

14. The image heating apparatus according to claim 9, wherein the snap-fit unit has a hole formed in the nip forming member, and wherein the regulation member is provided with a claw portion to engage with the hole.

15. The image heating apparatus according to claim 9, wherein the snap-fit unit has a hole formed in the regulation member, and the nip forming member is provided with a claw portion to engage with the hole.

16. The image heating apparatus according to claim 9, wherein the regulation member includes a guide unit located on the inner side of the endless belt and configured to guide the endless belt in a circumferential direction.

* * * * *